US006089956A

United States Patent [19]

Bohler

[11] Patent Number: 6,089,956

[45] Date of Patent: Jul. 18, 2000

[54] METHOD AND DEVICE FOR THE ABRASIVE BLASTING OF WORKPIECES

[75] Inventor: Daniel Bohler, Denzlingen, Germany

[73] Assignee: Gunther Bohler GmbH, Denzlingen, Germany

[21] Appl. No.: 09/057,334

[22] Filed: Apr. 8, 1998

[51] Int. Cl.[7] ..... B24C 1/00

[52] U.S. Cl. ..... 451/38; 451/40; 451/89; 451/90

[58] Field of Search ..... 451/36, 38, 40, 451/89, 90, 91

[56] References Cited

U.S. PATENT DOCUMENTS

| | | | |
|---|---|---|---|
| 955,714 | 4/1910 | Steedman | 451/90 |
| 3,599,375 | 8/1971 | Nunemaker | 451/89 |
| 3,665,570 | 5/1972 | Brooks | 451/38 |
| 4,232,487 | 11/1980 | Brown | 451/90 |
| 4,300,318 | 11/1981 | Bown | 451/89 |
| 4,603,515 | 8/1986 | Gilmore et al. | 451/90 |
| 5,143,102 | 9/1992 | Blaul | 451/89 |
| 5,177,911 | 1/1993 | Ruemelin et al. | 451/89 |

*Primary Examiner*—M. Rachuba
*Attorney, Agent, or Firm*—Fulwider Patton Lee & Utecht, LLP

[57] ABSTRACT

The present invention relates to a device and a method for abrasive blasting, in particular for the sand-blasting of relatively small workpieces, for example in the hobby sector (model building). The device comprises a chamber (2), which is closed in an essentially airtight manner on all sides and has at least one, and preferably a plurality of, closable openings (3), it being possible to evacuate the chamber. A blasting pipe unit (5), which can be introduced into the chamber via one of the openings and which has an inlet (12) for the blasting agent, an inlet (13) for air and an outlet opening (14) for the blasting agent, is connected to a blasting-agent container (8) via a feed line (7). Both the method and the device operate using subatmospheric pressure, so that it is possible, for example, to use a commercially available vacuum cleaner for evacuating the chamber. Owing to the subatmospheric pressure, the blasting agent remains in the chamber or is extracted via the extraction appliance, so that disturbance to the environment is minimal.

13 Claims, 1 Drawing Sheet

METHOD AND DEVICE FOR THE ABRASIVE BLASTING OF WORKPIECES

Figure 1:
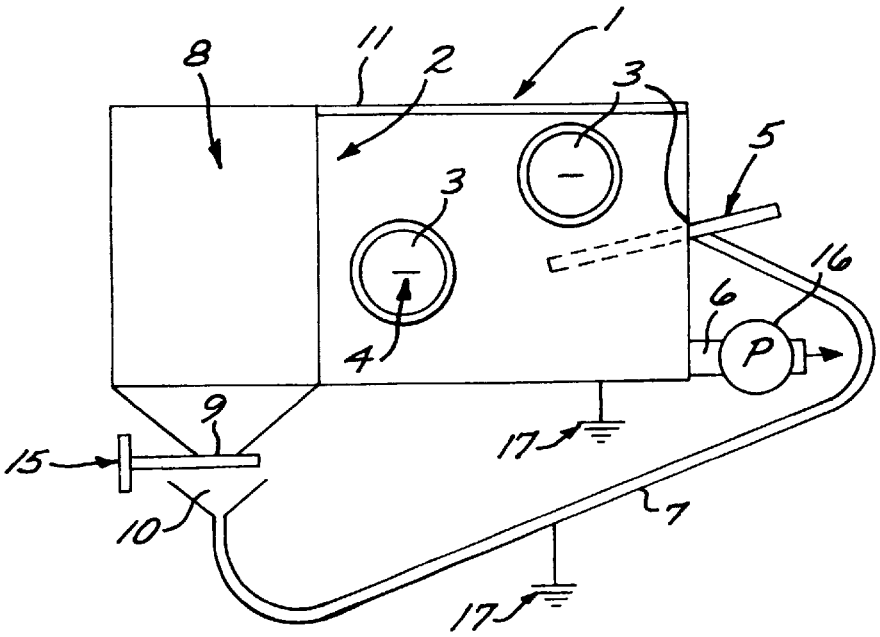

The present invention relates to a device and a method for abrasive blasting, in particular for the sand-blasting of workpieces, in particular of relatively small workpieces, for example in the hobby sector (model building).

Devices for abrasive blasting are known, for example, as sand-blasting devices. These known appliances generally comprise a blasting-agent container and a lance. The blasting agent, for example silica sand, is conveyed under pressure, by means of a compressor, through a hose leading from the blasting-agent container to the lance, with which it is then directed onto a workpiece to be treated.

These known devices are relatively expensive, in particular as a result of the need to use the compressor, so that they are uneconomical to use for occasional work, such as in the private or hobby sector, for example in model building.

Moreover, these devices are generally relatively large, and as a rule cannot be operated at low working pressures, so that it is scarcely possible to treat very small components in a satisfactory manner. A further drawback consists in the fact that with these devices a large amount of blasting agent passes into the surrounding area, thus ruling out use in living areas, or else the blasting agent can only be intercepted by using an additional closed booth, but this makes the installation even larger and more expensive.

The invention is based on the object of proposing a device and a method for the abrasive blasting of workpieces, in particular relatively small workpieces, which can be implemented cost-effectively, take up little space and can also be used, for example, in living areas.

According to the invention, this object is achieved by means of a device for the abrasive blasting of workpieces, having a chamber which is closed in an essentially airtight manner on all sides and has at least one, preferably a plurality of, closable openings, it being possible to evacuate the chamber, having a container for holding blasting agent, and having a blasting pipe unit, which can be introduced into the chamber via one of the closable openings and which has an inlet for the blasting agent, an inlet for air and an outlet opening for the blasting agent, it being possible to connect the inlet for the blasting agent to the blasting-agent container by means of a feed line.

According to the invention, the object relating to the method is achieved by means of a method for the abrasive blasting of workpieces, comprising the steps of: introducing a workpiece into a chamber which is closed in an essentially airtight manner on all sides, reducing the pressure in the chamber by extracting air from the chamber, and feeding a blasting agent and air, via a blasting pipe unit, into the chamber and onto the work-piece, the feed of the blasting agent being effected essentially by the suction action of the subatmospheric pressure in the chamber.

Both the method according to the invention and also the device operate using subatmospheric pressure, in contrast to the superatmospheric pressure used in the prior art. Since devices for extracting air are present in every household, for example in the form of vacuum cleaners, the blasting device according to the invention can be of very simple construction and can be produced cost-effectively, since the subatmospheric-pressure device, if it is not integrated in the device, can be connected as an external appliance. Thus even occasional use of the device, for example in the hobby sector (model building), is economically justifiable. Moreover, suction devices in the form of vacuum cleaners are produced in large numbers, and are therefore very advantageous. Owing to there being no pressure-carrying components, they are of fundamentally simpler design, are cost-effective and are less dangerous to use. A further advantage of the device according to the invention consists in the fact that the blasting agent remains in the closed chamber, owing to the subatmospheric pressure, or are extracted directly via the extraction appliance, so that disturbance to the environment is minimal and the device can be used even in the living area. The defined extraction also allows simple, correct disposal or recycling or reuse of the used blasting agent.

In a preferred refinement of the device according to the invention, the [sic] blasting pipe unit can be introduced into the chamber through the opening in such a manner that the outlet opening for the blasting agent is situated inside the chamber and the inlet for air is situated outside the chamber, and the opening of the chamber is essentially sealed around the blasting pipe unit.

According to a further advantageous refinement of the device, one or more of the openings in the chamber can be closed by means of a diaphragm seal or by means of a transparent disk, for example a plastic or glass disk.

The openings in the chamber allow both the blasting pipe unit and also the workpieces to be introduced into the chamber in different directions or at different positions. The use of elastic diaphragms, for example diaphragms having a slot, means that both the blasting pipe unit and a holding device for a workpiece, for example pincers or tweezers or the like, can be introduced into the chamber and moved from the outside while the substantial airtightness of the chamber is maintained by means of the independent seal of such diaphragms. If openings, for example even a cover of the chamber, are closed by means of a transparent disk, it is possible to observe the blasting work from the outside.

Finally, in a particularly advantageous refinement, a connection to the chamber is provided for connection to an appliance for extracting air from the chamber, and is configured in such a way that connection is possible both to such a device as an integral component of the device or to an external appliance, preferably a (commercial available) vacuum cleaner.

This results in particular in the abovementioned simplifications, since vacuum cleaners are present in every household.

Further advantageous refinements of the device according to the invention are given in the subclaims.

Figure 2:
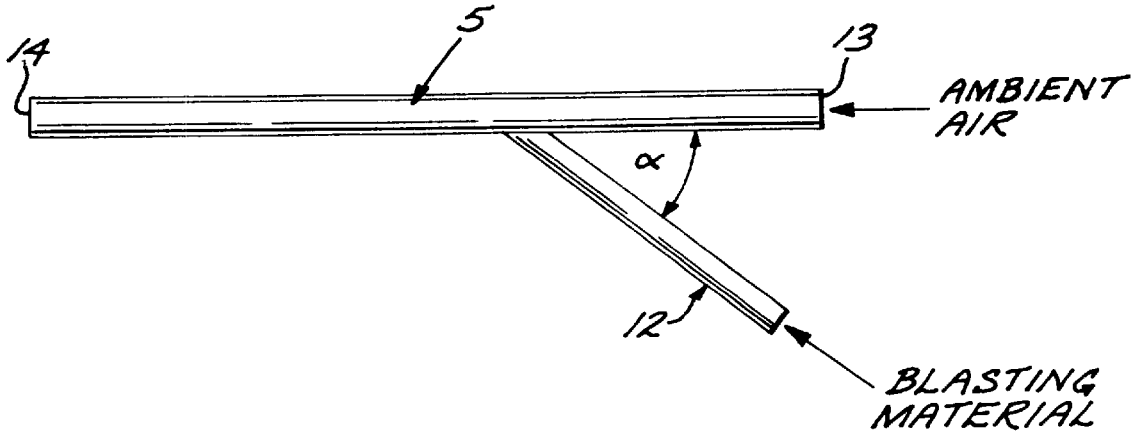

The invention is described in detail below with reference to the attached drawing, in which:

FIG. 1 shows a diagrammatic illustration of the device according to the invention, and FIG. 2 shows an enlarged, detailed illustration of the blasting pipe unit of the device according to the invention.

The embodiment, illustrated diagrammatically in FIG. 1, of the device 1 for the abrasive blasting of workpieces has a chamber 2 which is closed on all sides, is provided with a plurality of openings 3 and serves as a blasting booth. The dimensions of the chamber depend on the size of the workpieces and components to be treated and on the suction capacity of the extraction appliance to be described further below. For the hobby sector, for example in model building, the chamber may have the dimensions 300×200×200 mm. The chamber 2 per se may be made from any desired material, such as metal or plastic, and in any desired form, as long as the overall structure withstands the expected subatmospheric pressure in the interior and the abrasive action of the blasting agent used.

The openings 3 provided in the chamber serve for the introduction of the workpieces or of suitable holding devices, such as pincers, tweezers, grippers or the like, with which the workpiece to be treated can be held and moved. The openings are sealed by means of a suitable seal. Preferably, an elastic diaphragm 4 made of plastic or rubber is used, which diaphragm has a slot, so that the abovementioned tools can be introduced into the chamber through this slot while, at the same time, the elasticity of the material surrounds the particular tool and seals off the interior of the chamber with respect to the environment. The shape, size and arrangement of the openings 3 is per se arbitrary, as long as sufficient sealing and virtually airtight closure of the chamber are ensured. In this case, it is sufficient if the chamber is not closed in a completely airtight manner. The defining criterion for such a seal is that it is still possible to achieve a sufficiently reduced pressure by means of evacuation in the interior of the chamber during operation.

A larger opening is situated at the upperside surface of the chamber 2, through which opening the interior of the chamber 2 is accessible for assembly and cleaning purposes and workpieces can be introduced into the chamber. The opening on the top side can be closed off by means of a removable cover 11, which is preferably made from a transparent material, such as a plastic or glass disk, so that when the chamber is closed it is possible to look into the interior for the purpose of carrying out the work. A locking device for the cover 11 may be provided, but is not necessary per se, since the subatmospheric pressure in the chamber ensures that the cover is pressed down during operation. If appropriate, a surrounding seal may be provided. Transparent disks may also be provided at side openings, or else the chamber as a whole may be made predominantly of transparent material.

A container or reservoir 8 for holding the abrasive or blasting agent is provided next to the chamber 2. Silica sand or any other suitable fine-grained material may be used as the blasting agent. The container may be designed as a separate component or may be integrated in the device or the chamber. On the underside of the container 8, there is situated an outlet 9 with a metering device 15, by means of which the amount of blasting agent leaving the container can be adjusted or blocked off. The top side of the container 8 may remain open or can be closed off by means of a cover. In order to ensure that the blasting agent runs freely out of the container, it must be ensured that there is no subatmospheric pressure in the container.

An inlet funnel 10 is situated beneath the outlet 9 from the container 8. The force of gravity causes the blasting agent to fall into this funnel. It is then guided from the funnel 10 through a feed line 7 to a blasting pipe unit 5. The feed line 7 is preferably made from an elastic hose, for example a silicone hose having a diameter of 10 mm. However, it is also possible to use other materials or a suitably bent, rigid pipe.

At the other end of the feed line 7 is situated the blasting pipe unit 5, via which the blasting agent is guided into the chamber 2 and onto the workpiece. The blasting pipe unit 5 has a tubular main part with an inlet 12 for the blasting agent, an air inlet opening 13 and an outlet opening or nozzle 14 for the blasting agent and the air which has been sucked in. In operation, the blasting pipe unit 5, which serves as a lance, is introduced through one of the openings and into the chamber in such a manner that the outlet opening 14 for the blasting agent is situated inside the chamber and the blasting agent and air inlet openings 12, 13 are situated outside the chamber. Ambient air is sucked in through the air inlet opening 13 and is conveyed through the blasting pipe unit into the chamber. Under the action of the subatmospheric pressure which prevails in the chamber and is produced in a manner to be described further below, the blasting agent is also sucked in from the inlet funnel 10, through the feed hose 7, and into the blasting pipe unit, and is ejected from the outlet opening 14 together with the air. In order to achieve satisfactory suction of the blasting agent, the blasting agent inlet opening 12 is designed in the form of a tubular component which is arranged at an angle $\alpha$ to the longitudinal direction of the tubular main body or to the air flow direction, and the feed hose 7 can be attached and fixed to this tubular component. The angle $\alpha$ at which the blasting agent is fed to the blasting pipe unit is preferably an acute angle with respect to the air flow direction in the tubular main body. However, depending on the particular application, the angle may also be a right angle or an obtuse angle. The important factor is that the blasting agent be sucked in a satisfactory manner. The main body of the blasting pipe unit 5 is preferably produced from a tubular component, for example made of metal or a suitable plastic. By changing the size of the air inlet and blasting agent inlet and/or the internal diameter of the blasting pipe unit, the amount of blasting agent supplied and/or the speed thereof can be adjusted.

A connection stub 6 is provided on the chamber 2, to which stub a device for extracting air from the chamber 2 can be connected, for the purpose of evacuating said chamber. In a particularly preferred embodiment, this connection stub is designed in such a way that a commercially available vacuum cleaner 16 can be connected, if appropriate using an adapter and/or a connecting hose. However, it is also possible for the extraction appliance, in the form of a blower or a vacuum pump, to be an integral component of the device or an external appliance designed especially for the blasting device.

During operation of the extraction appliance or the vacuum cleaner 16, air is extracted from the interior of the chamber via the connection stub. The substantially airtight seal of the chamber means that only a small quantity of air can flow into the chamber, for example through the openings which are closed by diaphragms, so that said chamber is evacuated to a sufficient extent and hence a subatmospheric pressure is generated. The resulting suction action causes air and blasting agent to be pulled into the interior via the feed hose and through the blasting pipe unit. By suitably guiding the blasting pipe unit, the workpiece situated in the chamber can be treated in a controlled manner. The blasting power can be adjusted in a simple manner by altering the extraction power or the feed volume of blasting agent.

The extraction of the air from the chamber furthermore means that used blasting agent is also extracted. If a vacuum cleaner is used, this blasting agent passes into the filter bag of the vacuum cleaner and can be disposed of or, if appropriate, recycled or reused. In order to prevent relatively small workpieces from being extracted together with the air, a filter or grille may be provided at the extraction opening of the chamber. In order to improve the air turbulence in the chamber, a suitably shaped suction stub, for example in the shape of a T, may be provided in the interior of the chamber at the extraction opening.

Since feed hose, blasting pipe unit and possibly also the chamber or the blasting-agent container become electrostatically charged during operation as a result of the friction of the particles of the blasting agent, it is possible to attach a grounding cable 17 to the parts in question, in order to dissipate the charge via the cable, for example using a heating member or some other suitable grounding means.

What is claimed is:

1. Device for the abrasive blasting of workpieces, having a chamber (2) with at least one closable opening (3), an extraction device connected to the chamber (2) in order to extract air therefrom, a container (8) for holding blasting agent, and having a blasting pipe unit (5), which can be introduced into the chamber (2) via said closable opening (3) and which has an inlet (12) for the blasting agent, which inlet is connected to a feed line (7), an inlet (13) for ambient air and an outlet opening (14) for the blasting agent, whereby whence blasting pipe unit (5) is introduced into the chamber (2) through the opening (3) in the chamber (2), the blasting agent is transferred from the blasting agent container (8) via the feed line (7), together with the ambient air which is sucked in via the air inlet (13), into the chamber (2), owing to the subatmospheric pressure generated in the chamber (2) when the air is extracted therefrom.

2. Device for the abrasive blasting of workpieces according to claim 1, in which, at least one of the openings (3) in the chamber (2) is closed by means of a diaphragm seal (4) such that when the blasting pipe unit (5) has been introduced into the chamber (2), the opening (3) of the chamber (2) is sealed around the blasting pipe unit.

3. Device for the abrasive blasting of workpieces according to claim 1, in which at least one of the openings in the chamber can be closed by means of a transparent disk (11).

4. Device for the abrasive blasting of workpieces according to claim 1, in which the blasting pipe unit (5) comprises a tubular main body, at one end of which the outlet opening (14) for the blasting agent is situated and on which there are provided a connection (12) for the feed line (7) from the blasting-agent container (8) and the inlet (13) for the ambient air, the connection for the feed line (7) being arranged at an acute angle ($\alpha$) to the longitudinal axis of the tubular main body in the direction of the outlet opening (14).

5. Device for the abrasive blasting of workpieces according to claim 1, in which the blasting-agent container (8) has an outlet (9) with a metering device for adjusting the amount of blasting agent, and the feed line (7) has a funnel-shaped widening (10) at the end facing toward the container (8), which widening is arranged beneath the outlet (9), in order to receive blasting agent coming out of the container (8) under the force of gravity.

6. Device for the abrasive blasting of workpieces according to claim 1, in which the appliance for extracting air is an integral component of the device.

7. Device for the abrasive blasting of workpieces according to claim 1, in which said extraction device is an externally connectable appliance.

8. Device for the abrasive blasting of workpieces according to claim 7, in which said externally connectable appliance is a vacuum cleaner.

9. Device for the abrasive blasting of workpieces according to claim 1, in which said device is grounded in order to dissipate electrostatic charge.

10. Method for the abrasive blasting of workpieces, comprising the steps of:

introducing a workpiece into a chamber (2) which is closed in an essentially airtight manner on all sides, reducing the pressure in the chamber (2) by extracting air from the chamber (2), and feeding a blasting agent and air, via a blasting pipe unit, into the chamber and onto the workpiece, the feed of the blasting agent being effected essentially by the suction action of the subatmospheric pressure in the chamber.

11. Device for the abrasive blasting of workpieces according to claim 1, in which said feed line is grounded in order to dissipate electrostatic charge.

12. Device for the abrasive blasting of workpieces according to claim 1, in which said blasting pipe is grounded in order to dissipate electrostatic charge.

13. Device for the abrasive blasting of workpieces according to claim 1, in which said chamber is grounded in order to dissipate electrostatic charge.

* * * * *